US005198103A

United States Patent [19]

Meyer et al.

[11] Patent Number: 5,198,103

[45] Date of Patent: * Mar. 30, 1993

[54] METHOD FOR INCREASING LIQUID YIELDS FROM SHORT RESIDENCE TIME HYDROPYROLYSIS PROCESSES

[75] Inventors: Lee G. Meyer; Gerald F. Cavaliere, both of Englewood, Colo.

[73] Assignee: Carbon Fuels Corporation, Englewood, Colo.

[ * ] Notice: The portion of the term of this patent subsequent to Jun. 4, 2008 has been disclaimed.

[21] Appl. No.: 547,559

[22] Filed: Jul. 3, 1990

Related U.S. Application Data

[63] Continuation-in-part of Ser. No. 355,528, May 23, 1989, Pat. No. 5,021,148, which is a continuation-in-part of Ser. No. 277,603, Nov. 28, 1988, Pat. No. 4,938,782, which is a continuation-in-part of Ser. No. 84,270, Aug. 11, 1987, Pat. No. 4,787,915, which is a continuation-in-part of Ser. No. 59,288, Jun. 8, 1987, Pat. No. 4,832,831.

[51] Int. Cl.[5] ..... C10G 1/00

[52] U.S. Cl. ..... 208/431; 208/433; 44/282

[58] Field of Search ..... 208/431, 433; 44/282, 44/281

[56] References Cited

U.S. PATENT DOCUMENTS 4,938,782 7/1990 Meyer et al. ..... 208/431
5,021,148 6/1991 Meyer et al. ..... 208/431

*Primary Examiner*—Jacqueline Howard
*Attorney, Agent, or Firm*—Lee G. Meyer

[57] ABSTRACT

This invention generally relates a method for increasing the quantity and quality of hydrocarbon liquids derived from the short residence time decomposition and volatilization of coal. The invention more particularly relates to an improved method of economically producing uniform, fluidic, oil-type transportable fuel systems and fuel compositions and a slate of "value-added" co-products by a coal refining process employing a partial quench step as part of a short residence time hydrodisproportionation (SRT-HDP) reaction.

11 Claims, 2 Drawing Sheets

METHOD FOR INCREASING LIQUID YIELDS FROM SHORT RESIDENCE TIME HYDROPYROLYSIS PROCESSES

DESCRIPTION

1. Technical Field

This application is a continuation-in-part of U.S. patent application Ser. No. 355,528 filed May 23, 1989, now U.S. Pat. No. 5,021,148 issued Jun. 4, 1991, of its parent, U.S. patent application Ser. No. 277,603 filed Nov. 28, 1988 now U.S. Pat. No. 4,938,782 issued Jul. 3, 1990, and of its parent, U.S. patent application Ser. No. 084,270 filed Aug. 11, 1987 now U.S. Pat. No. 4,787,915 issued Nov. 29, 1988, and of its parent U.S. patent application Ser. No. 059,288 filed Jun. 8, 1987, now U.S. Pat. No. 4,832,831 issued May 23, 1989.

These parent, grandparent, great-grandparent, and great-great-grandparent applications, which are incorporated in their entirety by reference as if they were completely set out herein, disclose a coal refining process which economically produces a slate of clean burning value-added products. One process configuration produces non-polluting, fluidic, completely combustible, transportable fuel compositions derived from coal, which compositions contain particulate coal char admixed with liquids obtained from short residence time hydrodisproportionation of coal.

The parent application discloses a partial liquefaction scheme using short residence time hydrodisproportionation to produce petroleum substitutes.

The grandparent application relates to rapid volatilization of the coal particle followed by an uncatalyzed hydrogenation reaction to conserve hydrogen and increase liquid yield.

The great-grandparent application discloses that the method of carrying out the hydrodisproportionation process can be altered to vary the product and co-product distribution as well as the rheological characteristics of the fuel compositions.

The great-great-grandparent discloses that the method of processing the coal, and specifically hydrodisproportionation, is important in determining both the economics of the process and the slate of value-added co-products.

The ancestor applications, as a whole, relate to volatilization of coal to produce char and liquid co-products without utilization of external hydrogen, i.e., hydrogen other than that contained in the coal feedstock, and more particularly to an improved method of economically producing uniform, fluidic, oil-type transportable fuel systems and fuel compositions and a slate of "value-added" co-products by a coal refining process employing short residence time, high heating rate, hydrogen rearrangement (hydrodisproportionation).

2. Background Art

Coal is the world's most abundant fossil fuel. However, coal has three major drawbacks: (1) Coal is a solid and is less easily handled and transported than fluidic or gaseous materials; (2) Coal contains compounds which, on burning, produce the pollutants associated with acid rain; and (3) Coal is not a uniform fuel product, varying in characteristics from region to region and from mine to mine.

In fossil fuels, the ratio of hydrogen atoms to carbon atoms is most important in determining the heating value per unit weight. The higher the hydrogen content, the more liquid (or gaseous) the fuel, and the greater its heat value. Natural gas, or methane, has a hydrogen-to-carbon ratio of 4 to 1 (this is the maximum); gasoline has a ratio of almost 2.2 to 1; petroleum crude about 2.0 to 1; shale oil about 1.5 to 1; and coal about 1 to 1.

The lignites, peats, and lower calorific value subbituminous coals have not had an economic use except in the vicinity of the mine site, for example, mine mouth power generation facilities. This is due primarily to the cost of shipping a lower Btu, higher moisture product as well as to the danger of spontaneous combustion because of the high content of volatile matter which is characteristic of such coals.

The risk of spontaneous combustion of low-rank coals is increased by dehydration, even by non-evaporation methods. Therefore, in order to secure stability of the dehydrated coal in storage and transportation, it has been necessary to cover the coal with an atmosphere of inert gas such as nitrogen or combustion product gas, or to coat it with crude oil so as not to reduce its efficiency as a fuel. However, these methods are not very economical.

Waste coal has somewhat different inherent problems from those of the low-rank coals. Waste coal is sometimes referred to as a "non-compliance coal" because it is too high in sulfur per unit heat value to burn in compliance with the United States Environmental Protection Agency (EPA) standards. Other waste coal is too low in heat value to be transported economically.

The inefficient and expensive handling, transportation and storage of all types of coal (primarily because it is a solid material) prevent coal from being an exportable commodity and cause the conversion of oil-fired systems to coal to be economically unattractive. Liquids are much more easily handled, transported, stored and fired into boilers.

Besides being difficult to transport, coal is a heterogeneous fuel, i.e, coal from different reserves has a wide range of characteristics. Coal from one region (or even of a particular mine) cannot be efficiently combusted in boilers designed for coal from another source. Boilers and pollution control equipment must either be tailored to a specific coal or configured to burn a wide variety of material with a resultant loss in efficiency.

The non-uniformity and transportation problems are compounded by the presence in coal of combustion pollutants such as sulfur and nitrogen compounds which are thought to cause acid rain. The sulfur compounds are of two types: organic and inorganic (pyritic). The fuel bound nitrogen, i.e., organic nitrogen in the coal, combusts to form $NO_x$. Further, because of the non-uniformity of coal, it combusts with "hot spots" which result in some of the nitrogen in the combustive air (air is 75% nitrogen by weight) being oxidized to produce $NO_x$. This so-called "thermal $NO_x$" has heretofore been reduced only by boiler modification systems or expensive catalytic reduction systems.

Raw coal cleaning techniques remove inorganic ash and sulfur; however, traditional cleaning has not been able to remove the organic nitrogen and organic sulfur compounds which, upon combustion, produce $SO_x$ and $NO_x$ pollutants. Combustion technologies such as fluidized bed boilers, which require limestone as an $SO_x$ reactant, and post-combustion technologies such as scrubbers or $NO_x$ selective catalytic convertors have been the main focus in seeking to alleviate these pollution problems. These devices, which clean the combustion and flue gas rather than the fuel, are tremendously expensive from both capital and operating standpoints, adding to the cost of power. This added power cost not only increases the cost of domestically produced goods, but also ultimately diminishes this nation's competitiveness with foreign goods. Moreover, operation of post-combustion pollution control equipment draws on the power generated in the plant, reducing saleable plant output. This inefficiency results in higher production of $CO_2$ per unit of power available for sale. Production of $CO_2$ has been linked with the "greenhouse" effect, i.e. the warming of the earth's atmosphere.

It would, therefore, be advantageous to clean up the coal by removing the fuel nitrogen as well as both the organic and the pyritic sulfur while providing a uniform, highly reactive fuel which burns at a lower temperature, thereby reducing the production of thermal $NO_x$.

In order to overcome some o the inherent problems with coal as a solid fuel, various methods have been proposed for utilizing coal to produce synthetic liquid or gaseous fuels. These liquefaction or "synfuel" processes are capital intensive and require a great deal of externally supplied water and hydrogen, i.e., hydrogen and water provided from other than the coal feedstock. These processes are also energy intensive in that most carbon atoms in the coal matrix are converted to hydrocarbons, i.e., no pure carbon is produced. This differs markedly from merely "rearranging" existing hydrogen in the coal molecule, as in hydrodisproportionation, to hydrogenate certain carbon atoms at the expense of other carbon atoms.

Coal pyrolysis is a well-known process whereby coal is thermally volatilized by heating the coal out of contact with air. Different pyrolysis products may be produced by varying the conditions of temperature, pressure, atmosphere, and/or material feed. Traditional pyrolysis has produced very heavy hydrocarbon tars and carbon (char), with the liberation of hydrogen.

In prior art pyrolysis, as shown in FIG. 2, the pulverized coal is heated relatively slowly at low heating rates and long residence times such that the coal molecule undergoes a decomposition at reaction rate '$k_2$' to yield "decomposition" products, primarily free radical hydrocarbon fragments., These "decomposition" products undergo a recomposition or "condensation" reaction at reaction rate '$k_2$', producing char and dehydrogenated hydrocarbons and liberating hydrogen. The decomposition reaction is not desirable in a refining process because it liberates valuable hydrogen instead of utilizing it to upgrade the hydrocarbon products. As shown in FIG. 2, when $k_1$ and $k_2$ overlap, the dehydrogenation of the decomposition product, i.e., condensation reaction, is predominant. It is believed that when the coal is heated slowly, the decomposition reaction takes place within the coal particle where there is little hydrogen present to effect the hydrogenation reaction. Thus, the decomposed molecular fragments condense, which results in the production of heavy tar-like liquids of very limited utility.

Other prior art processes for treatment of bituminous and subbituminous coals of various ranks attempted to hydrogenate decomposition products by adding external hydrogen. These hydropyrolysis processes have been carried out in both the liquid and gaseous phases, with the most economical processes taking place under milder conditions. However, these processes have had only limited success in producing economical products. As in traditional pyrolysis, if the heating rates are not rapid, the decomposition material remains inside the coal particles and cannot be hydrogenated by external hydrogen. In order to promote hydrogenation, more stringent reaction conditions were employed, reducing process economic viability. Examples of such processes are disclosed in U.S. Pat. Nos. 4,704,134; 4,702,747; and 4,475,924. In such processes, coal is heated in the presence of hydrogen or a hydrogen donating material to produce a carbonaceous component called char and various hydrocarbon-containing oil and gas components. Many hydropyrolysis processes employ externally generated additional hydrogen which substantially increases the processing cost and effectively makes the process a "liquefaction" process.

A particular type of coal hydropyrolysis, flash hydropyrolysis, is characterized by a very short reactor residence time of the coal. Short residence time (SRT) processes are advantageous in that the capital costs are reduced because the feedstock throughput is so high. In SRT processes, high quality heat is required to effect the transformation of coal to char, liquids and gases. A terminal quench is used with many of these processes to terminate the reactions.

In many processes, hydrogen is oxidized within the reactor to gain the high quality heat. However, the oxidation of hydrogen in the reactor not only creates water but also reduces the amount of hydrogen available to hydrogenate hydrocarbons to produce higher quality fuels. Thus, in prior art processes, either external hydrogen is required or the product is degraded because valuable hydrogen is converted to water.

The prior art methods of deriving hydrogen for hydropyrolysis are either by: (1) purchasing or generating external hydrogen, which is very expensive; (2) steam-methane reforming followed by shift conversion and $CO_2$ removal as disclosed in a paper by J. J. Potter of Union Carbide; or (3) char gasification with oxygen and steam followed by shift conversion and $CO_2$ removal as disclosed in a paper by William J. Peterson of Cities Service Research and Development Company.

All three of these hydrogen production methods are expensive, and a high temperature heat source, such as direct $O_2$ injection into the hydropyrolysis reactor, is still required to heat and devolatilize the coal. In the prior art processes, either carbon (char) is gasified by partial oxidation, such as in a Texaco gasifier (U.S. Pat. No. 4,491.456 to Schlinger and U.S. Pat. No. 4,490,156 to Marion et al.), or oxygen is injected directly into the reactor. One such system is disclosed in U.S. Pat. No. 4,415,431 (1983) of Matyas et al. When oxygen is injected directly into the reactor, it preferentially combines with hydrogen to form heat and water. Although this reactor gives high-quality heat, it uses up hydrogen which is then unavailable to upgrade the hydrocarbons. This also produces water that has to be removed from the reactor product stream and/or floods the reactor. Additionally, the slate of hydrocarbon co-products is limited.

Flash hydropyrolysis processes can produce relatively high liquid hydrocarbon yields. A drawback is that if the volatilization products are immediately quenched to terminate reactions, the liquid hydrocarbons produced contain a large fraction of heavy liquids which are difficult and expensive to upgrade. Additionally, the volatilization products from extremely short residence time processes are relatively unstable, i.e., not sufficiently hydrogenated. To reduce the fraction of heavy liquid hydrocarbons produced and to increase hydrogenation, others such as Rockwell and Cities Service allow the volatilization products to remain in the reactor (at volatilization temperature) for relatively long residence times. However, at the high volatilization temperatures associated with flash hydropyrolysis processes, and at long residence times, lighter liquid hydrocarbons as well as heavy liquid hydrocarbons are thermally cracked to light hydrocarbon gases (primarily methane). This substantially reduces the total liquid hydrocarbons produced and significantly increases hydrogen consumption.

Thus, it would be advantageous to have a means for producing: (1) a high yield of high quality liquid hydrocarbons, (2) high quality heat for volatilization, (3) hydrogen, and (4) other reducing gases prior to the reaction zone without producing large quantities of water and without using up valuable hydrogen.

In U.S. Pat. Nos. 4,671,800 and 4,658,936, it is disclosed that coal can be subjected to pyrolysis or hydropyrolysis under certain conditions to produce particulate char, a gas fraction, and a liquid organic fraction. The liquid organic fraction is rich in hydrocarbons, is combustible, can be beneficiated and can serve as a liquid phase for a carbonaceous fluidic fuel system. The co-product distribution, for example hydrocarbon fractions such as BTX and naphtha, and the viscosity, pumpability and stability of the fuel when the char is admixed with the liquid organic fraction, are a function of process parameters. The rheology of the fuel system is a function of solids loading, sizing, surfactants, additives, and oil viscosity.

The economic feasibility of producing the fluidic fuel is predicated on the method of volatilizing the coal to produce the fuel system and a slate of value-added co-products. The economics of transporting the fluidic fuel are predicated upon the rheology of the fuel system.

Common volatilization reactors include the fluidized bed reactor which uses a vertical upward flow of reactant gases at a velocity sufficient to overcome the gravitational forces on the carbonaceous particles, thereby causing suspension of the particles in a gaseous medium. In the fluidized bed reactor, particles are subjected to longer reaction residence times to obtain conversion into liquid and gaseous hydrocarbons. Thus, this type of reactor is not very conducive to short residence time (SRT) processing and may produce a large quantity of polymerized (tar-like) hydrocarbon co-products.

Another common reactor is the entrained flow reactor which utilizes a high-velocity stream of reactant gases to impinge upon the carbonaceous particles and carry them through the reactor vessel. Entrained flow reactors are characterized by smaller volumes of particles and shorter exposure times to the high-temperature gases. Thus, these reactors are useful for SRT-type systems.

In one prior art two-stage entrained flow reactor, a first stage is used to react carbonaceous char with a gaseous stream of oxygen and steam to produce hydrogen, oxides of carbon, and water. These products continue into the second stage where volatile-containing carbonaceous material is fed into the stream. The carbonaceous feed reacts with the first-stage gas stream to produce liquid and gaseous hydrocarbons, including large amounts of methane gas and char.

Prior art two-stage processes for the gasification of coal to produce primarily gaseous hydrocarbons include U.S. Pat. Nos. 4,278,445 to Stickler; U.S. Pat. No. 4,278,446 to Von Rosenberg, Jr.; and U.S. Pat. No. 3,844,733 to Donath. U.S. Pat. No. 4,415,431 issued to Matyas et al. shows use of char as a carbonaceous material to be mixed with oxygen and steam in a first-stage gasification zone to produce a synthesis gas. Synthesis gas, along with additional carbonaceous material, is then reacted in a second-stage hydropyrolysis zone wherein the additional carbonaceous material is coal to be hydropyrolyzed.

U.S. Pat. No. 3,960,700 to Rosen describes a process for exposing coal to high heat for short periods of time to maximize the production of desirable hydrocarbons.

One method of terminating the volatilization reaction is by quenching the products either directly with a liquid or gas, or by use of a mechanical heat exchanger. In some cases, product gases or product oil are used. Many reactors, including those for gasification have employed a quench to terminate the volatilization reaction and prevent polymerization of unsaturated hydrocarbons and/or gasification of hydrocarbon products. Some have employed intricate mechanical heat-exchange quenches to attempt to capture the heat of reaction. One such quench scheme is shown in U.S. Pat. No. 4,597,776 issued to Ullman et al. The problem with these quench schemes is that they introduce mechanical apparatus into the reaction zone. This can cause tar and char accumulation on the heat-exchanger devices, thereby fouling the heat exchanger.

Thus, if the coal has a hydrogen-to-carbon ratio of 1, and if the hydrogens on half the carbons could be transferred or "rearranged" to the other half of the carbons, then the result would be half the carbons with 0 hydrogens and half with 2 hydrogens. The first portion of carbons (with 0 hydrogens) is char; the second portion of carbons (with 2 hydrogens) is a liquid product similar to a petroleum fuel oil. If this could be accomplished using only hydrogen inherent in the coal, i.e., no external hydrogen source, then the coal could be refined in the same economical manner as petroleum, yielding a slate of refined hydrocarbon products and char.

It would be highly advantageous to have a method for increasing oil yields in short residence time hydropyrolysis processes which would allow good carbon conversion by effecting a high heat rate while minimizing thermal cracking to gas and simultaneously increasing the liquid yield. Further, it would be advantageous to have a method for minimizing heavy hydrocarbons and tar-like materials while increasing the quality and quantity of hydrocarbon liquids.

Further, it would be highly advantageous to have a system for refining coal wherein short residence times and internally generated hydrogen are used to effect high carbon conversion while efficiently producing and then preserving high quality hydrocarbon liquids without excess gasification of such products by cracking. In such a system, inherent hydrogen in the coal could be conserved to increase the co-product value and minimize the process operating costs.

In U.S. patent application Ser. No. 277,603, now U.S. Pat. No. 4,938,782 issued Jul. 3, 1990, it is disclosed that coal can be refined in the presence of internally generated hydrogen to effect high oil yields without attendant gas production and heavy tar formation. It has now been unexpectedly discovered that the production and quality of hydrocarbon liquids can be greatly increased by use of at least one intermediate quench prior to a final quench to effect a temperature which promotes hydrogenation but retards gasification. At this temperature, heavy liquid hydrocarbons are preferentially cracked to lighter liquid hydrocarbons, and volatilization products are hydrogenated in the hydrogen-rich atmosphere.

SUMMARY OF THE INVENTION

The instant invention relates generally to an improved method for deriving increased hydrocarbon liquids from short residence time hydropyrolysis processes by employing at least one partial quench prior to a final quench to effect increased hydrogenation and increased cracking to gas. In accordance with the invention hydrocarbon vapors and char material produced by short residence time hydropyrolysis and are subjected to at least one intermediate partial quench to reduce hydropyrolysis temperatures and effect hydrogenation temperatures.

In one embodiment, at least one hydrogen donor-rich quench medium is used. In a preferred embodiment, elemental hydrogen is at least one quench medium. In a further embodiment, heavier hydrocarbon process liquids, either alone or admixed with hydrogen, are recycled as at least one quench medium. In accordance with this embodiment, the heavier hydrocarbon process liquids are cracked to lighter liquid hydrocarbon material, thus increasing the quantity and quality of the hydrocarbon liquids produced.

More particularly, the instant invention relates to an improved method for refining coal by short residence time "thermolysis" in the presence of hydrogen (hydropyrolysis) to produce high quality hydrocarbon liquids.

It has now been unexpectedly discovered that higher carbon conversion and increased hydrocarbon liquid yields can be effected in short residence time hydrodisproportionation (SRT-HDP) processes by utilizing at least one "intermediate" partial quench in the presence of a hydrogen-rich atmosphere prior to the final quench to effect hydrogenation of the volatilization products and minimize thermal cracking of liquid hydrocarbons to hydrocarbon gases.

In accordance with the invention, particles of volatile-containing carbonaceous material are heated with hot hydrogen-rich gas at a rate effective to rapidly decompose and volatilize the solid, organic material into hydrocarbon fragments and free radicals, causing them to "exit" the carbonaceous particle. These volatilized, hydrocarbon fragments are subjected to at least one intermediate quench to effect hydrogenation temperature by intimate contact with a hydrogen donor in an intermediate quench medium hydrogen-rich gaseous reducing atmosphere to promote the "hydrogenation" of the fragments and free radical "hydrogen capping" and to inhibit condensation reactions. Although some hydrocracking occurs (primarily heavy liquid hydrocarbons to lighter liquid hydrocarbons), the hydrogenation temperature and the hydrogenation residence time are selected to reduce thermal hydrocracking and gasification. By rapidly heating the particles of carbonaceous material to a volatilization temperature effective to decompose the solid organic material and then hydrogenating the decomposition product at hydrogenation temperatures which are produced by an intermediate partial quench in the presence of a hydrogen-rich atmosphere to produce stable, high quality hydrocarbon liquids from internally generated hydrogen while gas production from both the "condensation" reaction and hydrocracking is minimized. Thus, depolymerization and high heating rates can be obtained to increase the decomposition reaction rate while hydrogenation temperatures are selected to effect efficient hydrogenation of decomposition products, without promoting attendant gasification and/or decomposition reactions.

The present process involves an improved method for refining a volatile containing carbonaceous material to produce a slate of hydrocarbon-containing products by the intermediate quenching of the reaction products from short residence time hydrodisproportionation to a hydrogenation temperature. The process contemplates a heating step wherein volatile-containing carbonaceous particles are rapidly heated at a rate effective to minimize condensation and the formation of char to volatilization temperatures effective to depolymerize and produce decomposed and volatilized product. The decomposed product is contacted with a hydrogen donor-rich gaseous atmosphere at a hydrogenation temperature to effect hydrogenation and hydrogen capping of the decomposed, volatilized material. The hydrogenation is accomplished at residence times effective to complete hydrogenation of the fragments. The hydrogenated material can then be quenched to a stabilization temperature below the reaction temperature to prevent deterioration of the liquid products to gas by thermal hydrocracking and/or to inhibit the condensation reaction.

In a preferred embodiment, a hydrogen donor-rich gaseous reducing atmosphere, obtained in substantial part from the carbonaceous material, is used as the partial quench stream to reduce the temperature below the decomposition temperature and to effect a hydrogenation temperature. In accordance with a further preferred embodiment, the hydrogenated material is quenched further to effect stabilization, i.e., prevent further hydrocracking and/or condensation reaction of the liquids.

In another embodiment, the hydrocarbon-containing decomposition vapor from the hydrodisproportionation reaction is subjected to an intermediate quench to hydrogenation temperatures in a hydrogen donor-rich gaseous reducing atmosphere by contacting said vapor with a heavy oil component (primarily hydrocarbons boiling above about 700° F.) recovered from the HDP vapor and recycled. This partial quench, in addition to reducing the temperature of the decomposition vapor, increases the temperature of the heavy oil to a sufficiently high temperature to effect a "thermal cracking" of the heavy oil to lighter oil. In another embodiment, the partial quench can be effected by a mixture of recycled, hydrogen-rich gas and heavy liquid hydrocarbons. Preferably, a second quench medium, which can comprise water and light oil (primarily hydrocarbons boiling below about 400° F.) recovered from the HDP vapor, is used to reduce the temperature of the vapor to effect stabilization. In a greatly preferred embodiment, a partial oxidation reactor is used to produce the heat for volatilization/decomposition and to generate the hydrogen donor-rich gaseous atmosphere.

DESCRIPTION OF THE PREFERRED EMBODIMENT

Figure 1:
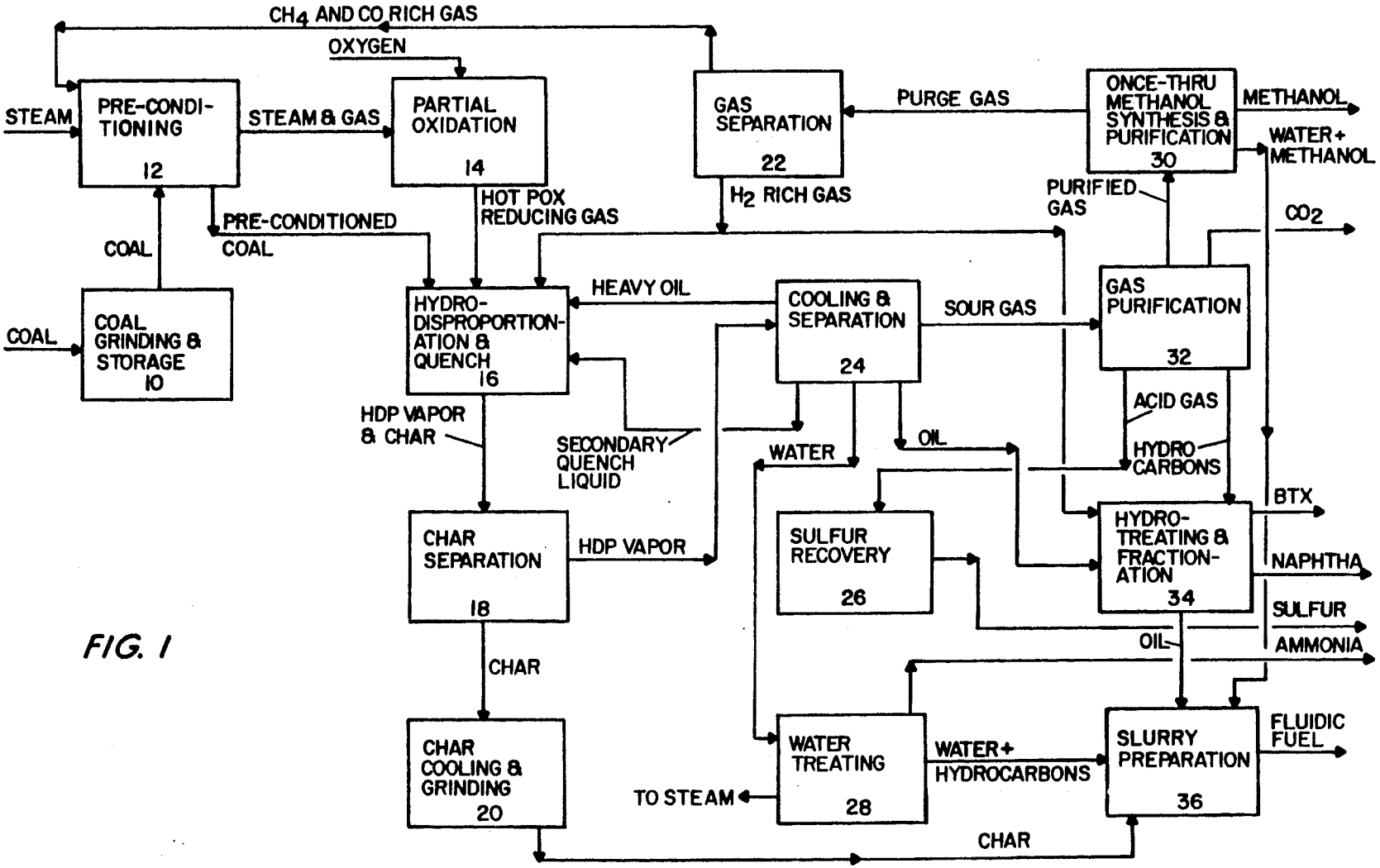
FIG. 1 is a flow sheet schematic for the coal hydrodisproportionation ("HDP") process of the present invention where numbered blocks refer to unit process steps and/or facilities as contemplated by the practice of the instant invention and described in the following specification.

The process of the instant invention commences with coal feedstock received at the plant battery limits. Referring to FIG. 1, the feedstock is conveyed to coal grinding and storage unit 10 where the coal is reduced to size and partially dried, if necessary. The sized and partially dried coal is fed to a preconditioning unit 12 (optional) that preconditions and preheats the coal by direct contact with superheated steam and recycled gas from gas separator unit 22. Steam and recycled gas from preconditioning unit 12, and oxygen from the air separation plant (not shown) are reacted as first stage reactions in partial oxidation (POX) unit 14 to produce a hydrogen-rich reducing gas at a high temperature (as later more fully described). The hot POX gas provides the heat, hydrogen, and reducing atmosphere (CO) necessary for short residence time hydrodisproportionation (SRT-HDP) of the carbonaceous material in the hydrodisproportionation and quench unit 16 as well as the make-up hydrogen needed for hydrotreating the HDP liquids in the downstream hydrotreating and fractionation unit 34.

The preconditioned coal from unit 12 is contacted with the hot POX gas from unit 14 in an SRT-HDP reactor and quench unit 16. The coal is rapidly depolymerized and hydrodisproportionated to char and HDP vapors. The residence time in the reactor is from about 2 milliseconds to about 100 milliseconds and preferably 10 milliseconds to 75 milliseconds and more preferably 15 milliseconds to 50 milliseconds, depending on the rank of the coal and the reactivity of the catalyst. In order to prevent cracking and continued reactions (polymerization and/or condensation) of heavy, unsaturated hydrocarbons, the HDP vapor is initially quenched to a hydrogenation temperature in the order of from about 900° F. to about 1500° F., and preferably from about 1000° F. to about 1300° in the lower portion of the SRT-HDP reactor with recycled, hydrogen-rich gas from unit 22. Subsequently, the hydrogenated materials are stabilized by a secondary or down stream quench to stabilization temperatures below 1000° F., and preferably below 900° F. by a light oil/water mixture quench. The hydrogenation reactions occur for residence times well known in the art depending upon temperature. Residence times of from about 0.1 to about 5.0 seconds are sufficient.

The char produced in unit 16 is separated from the HDP vapors in the char separation unit 18 and most of the char is sent to char cooling and grinding unit 20. A small amount of the hot char is sent to a steam boiler, for example, a fluidized bed boiler (not shown), where it is combusted to produce steam required for preconditioning unit 12. The water to produce the steam is obtained from the water treatment unit 28. The cooled and sized char (32% minus 325 mesh) is mixed with hydrotreated oil, methanol, and an emulsifying amount of water to produce a non-polluting fluidic slurry fuel system which is a co-product of the instant invention in slurry preparation unit 36.

The hot quenched HDP vapors are cooled to recover heat and scrubbed to remove residual char dust in cooling and separation unit 24. The condensed oil and water are separated. The separated oil is sent to hydrotreating and fractionating unit 34.

The separated water is stripped in water treating unit 28 to remove dissolved gases and ammonia. Anhydrous ammonia is then recovered as a co-product and sent to storage (not shown). The stripped water is concentrated in unit 28 where dissolved organics and salts are concentrated in a small fraction of the water. The concentrate, which is high in hydrocarbon content, is then moved to slurry preparation unit 36 for use as emulsifying water in the preparation of the fluidic fuel system. The distillate water from the concentrator is used to produce steam in the steam boiler (not shown). Thus, there is no water discharge effluent from the facility.

The non-condensed cooled sour gas from unit 24, which has been scrubbed to remove char dust, is conveyed to the gas purification unit 32 where sulfur compounds, trace impurities and most of the carbon dioxide are removed. Naphtha range hydrocarbons in the gas are also removed in unit 32 and moved to hydrotreating and fractionating unit 34. The removed sulfur components are sent to a sulfur recovery unit 26 where the sulfur is recovered by conventional means as a co-product and sent to storage (not shown). The separated $CO_2$ from unit 32 is compressed by conventional means to about 2,000 psia and removed by pipeline (not shown) as a co-product for use in enhanced oil recovery, agriculture, and the food industry. The purified gas from gas purification unit 32 is sent to a "once-through" methanol synthesis unit 30 where, in a single pass, part of the $H_2$, CO and $CO_2$ in the gas is converted by the catalytic converter to methanol and water. The crude methanol produced is purified in unit 30 by, for example, distillation, and pure methanol is separated and moved to storage (not shown). A high concentration of methanol in a water stream (up to 95% methanol by volume) is also separated and moved to the slurry preparation unit 36 for preparation of the fluidic fuel system. This stream negates the necessity for expensive methanol purification while providing a diluent and thermal $NO_x$ supressant to the fluidic fuel. Unreacted gases are purged from the methanol synthesis unit and moved to gas separation unit 22.

In gas separation unit 22, the purged gas from methanol synthesis is separated into two streams; a hydrogen rich gas and a methane/carbon monoxide-rich gas. Part of the separated hydrogen-rich gas is compressed and recycled to the SRT-HDP reactor in unit 16. The remainder of the hydrogen-rich gas is sent to hydrotreating and fractionation unit 34. The methane/carbon monoxide rich gas is heated and then recycled to the preconditioning unit 12.

The naphtha range hydrocarbons from unit 32 are hydrotreated and benzene-toluene-xylene (BTX) is then separated by extractive distillation in unit 34. The BTX and naphtha are removed to storage (not shown). The separated oil (380° F.+boiling hydrocarbons) from unit 24 is also hydrotreated in unit 34. The hydrotreated oil is moved to unit 36 to be mixed with char to produce the instant fluidic fuel. This hydrotreated oil has a heating value in excess of 18,000 Btu/lb and is substantially devoid of $SO_x$ and $NO_x$ producing compounds.

Feedstock

The carbonaceous materials that can be employed as feedstock in the instant process are, generally, any volatile-containing material which will undergo hydropyrolytic destructive distillation to form a particulate char and volatilization products. Bituminous and subbituminous coals of various ranks as well as waste coals and lignites are examples. Peat may also be used. Anthracite, which contains minimal volatiles, is not a preferred feedstock.

Preferably, coals from the lignite rank to the medium volatile bituminous rank are used. Lignites are an advantageous starting material for the instant invention since they contain process water for hydrodisproportionation and manufacture of methanol, as well as up to 55% by weight volatiles (on a dry basis). Additionally, utilizing an intermediate quench, as disclosed herein, preserves the high liquid yield produced in the SRT-HDP reactor and lowers the viscosity of such liquids.

The mining and preparation is fully described in Kirk-Othmer ENCYCLOPEDIA OF CHEMICAL TECHNOLOGY, second edition, Vol. 5, pp. 606–676. The coal is mined by either strip or underground methods as appropriate and well known in the art.

Feedstock Preparation

The raw coal, which preferably has a particle size of less than about 5 cm, is normally subjected to crushing to reduce the particle size. Preferably, the coal is pulverized to 70 percent minus 200 mesh. The need for size reduction and the size of the reduced material depends upon the process conditions to be used, i.e., the heating rate and the volatilization temperature, as well as the composition and rank of the coal material, particularly its agglomerating tendencies and the inorganic sulfur and ash content of the coal. When beneficiation is necessary, for example, with coals containing a high percentage of ash or inorganic sulfur, the coal is preferably ground and subjected to washing and beneficiation techniques. When coals are used which have agglomerating tendencies, the size of the coal must be matched to the hydrodisproportionation techniques and process conditions in order to produce a particulate char and to prevent agglomeration during HDP.

Referring to FIG. 1, unit 10 includes coal receiving, storage, reclaiming, conveying, grinding, and drying facilities required to prepare the coal for introduction to the HDP unit 16. This unit 10 also includes facilities to grind or pulverize the feed coal from a received size of 5 cm to 70 percent minus 200 mesh and to dry the coal to from about 1% to 12% by weight moisture and preferably 2% to about 4% by weight moisture.

The crushing, pulverizing and/or grinding can be accomplished with any equipment known in the art, but preferably is accomplished with impact mills such as counter-rotating cage mills, hammer mills or the like. The pulverizers are swept with a stream of heated gas which partially dries the coal. Pulverizer outlet temperature is maintained at from about 100° to about 500° F. and preferably from 150° F. to about 400° F.

The ground coal is pneumatically conveyed to a set of cyclones located in coal preconditioner unit 12. Part of the gas from these cyclones is returned to the pulverizer circuits and the remainder of the gas is sent to a bag house prior to being vented to the atmosphere. Fugitive dust collectors are provided at transfer points to minimize coal dust emissions to the atmosphere. Advantageously, carbonaceous fines and the like are subjected directly to hydrodisproportionation.

Coal Preconditioning

Unit 12 of FIG. 1 includes coal pre-conditioning with steam and methane/carbon monoxide ($CH_4$/CO) rich gas. Pneumatically conveyed coal from coal grinding unit 10, is fed to a cyclone separator to separate the coal from the transport gas. Most of the transport gas is recycled back to coal grinding unit 10. A slip-stream is diverted to a bag filter to remove entrained coal dust prior to exhausting to the atmosphere. The coal from the cyclone separators and bag filter is sent to a coal feed surge bin. The coal is normally fed through lockhoppers which are pressurized with high pressure nitrogen from the air separation plant. After an upper lockhopper is filled with coal, it is then pressurized prior to its discharging coal to the lower lockhopper. The emptied upper coal lockhopper is then depressurized to atmospheric pressure and is again filled with coal from the surge bin. Lockhopper valves are controlled, for example, by a microprocessor unit which is used to control the coal filling, pressurization, coal feeding and depressurization sequence.

The coal preconditioner unit 12 is preferably a fluidized bed vessel in which coal from the lockhoppers is contacted with $CH_4$/CO rich recycle gas and steam at from about 100 psig to about 1,200 psig, preferably about 400 psig to about 800 psig, and more preferably in the range of about 500 psig to about 700 psig, at a temperature from about 600° F. to about 1,050°, preferably about 800° F. to about 1,000° F., and more preferably about 950° F. The coal is contacted with the heated gas and steam to provide mixed coal and gas temperatures at a temperature between about 350° F. and about 650° F. The exact temperature will depend upon the coal. Coking and agglomerating coals are especially sensitive to mixing temperatures. The residence time of the coal in the pre-conditioner varies from about 30 seconds to 3 minutes, preferably about 2 minutes, depending on the desired temperature, coal particle size distribution, rank of coal, and throughput rate. The velocity of the steam is preferably adjusted to suspend the coal particles in the steam (fluidized bed). The superheated steam and gas preheats and pre-conditions the coal prior to the coal being fed to the SRT-HDP reactor within unit 16. Steam, gas, and entrained coal from the fluidized bed is fed to a separator, for example, an internal cyclone, where the coal is separated and returned to the fluidized bed while the resultant steam and gas stream containing entrained hydrocarbons from the separator is sent to a POX reactor (unit 14). These entrained gases have value as fuel in the POX reactor or as a hydrogen source in the HDP. The preconditioned coal from the preconditioner is moved to the HDP reactor.

Advantageously, the preconditioning is carried out using process heat from both the char and hot gases liberated during the HDP reaction. Neither the preconditioning steam nor the entrained hydrocarbons are emitted into the air but, in fact, are used in the POX unit 14. The entrained hydrocarbons are used as a fuel source in the partial oxidation reactor to increase heat and produce hydrogen, CO and the like. Preconditioning is optional depending upon the increased liquid yield of a particular rank of coal versus the capital and operating costs of the preconditioning unit.

Partial Oxidation

Referring to FIG. 1, the POX process, depicted as unit 14, may comprise any pressurized partial oxidation reactor capable of producing synthesis gas ($H_2$ and CO). This process produces hydrogen, high quality heat and a reducing atmosphere (CO) for the hydrodisproportionation reaction, as well as the production of hydrogen for downstream hydrotreating and for reducing sulfur and nitrogen. The POX process may be combined as a first stage of the HDP reactor or, preferably, may be accomplished in a separate unit as shown in FIG. 1. In the POX reactor, methane/carbon monoxide-rich gas and steam are sub-stoichiometrically reacted with oxygen to produce a hydrogen-rich gas, CO, and high quality heat. The $CH_4$/CO-rich gas is preferably reaction gas from the gas separation unit 22 discussed hereinbelow. The hydrogen-rich gas, the CO and unreacted steam from the POX reactor are at a high temperature and provide the required heat and reducing atmosphere necessary for hydrodisproportionating the coal.

More specifically, in the present process, a fuel gas, preferably a CO-rich methane, and more preferably a purified reaction gas, is introduced into a first-stage reactor with oxygen. The oxygen is present in an amount less than the stoichiometric amount required to react with all of the fuel gas. An amount of steam sufficient to preferentially inhibit the production of water is also introduced. The steam is preferably derived from preconditioning the coal. The CO in the gas stream is preferred for the selective production of hydrogen by extraction of oxygen from water. This occurs in accordance with one or more of the following reactions:

$$CH_4 + \tfrac{1}{2} O_2 \rightarrow CO + 2H_2$$

$$CH_4 + O_2 \rightarrow CO_2 + 2H_2$$

$$CH_4 + H_2O \rightarrow CO_2 + 3H_2$$

$$CO + H_2O \rightarrow CO_2 + H_2$$

Generally, the oxygen is introduced into the first-stage reactor in an amount to provide a molar ratio of oxygen to $CH_4$/CO within a range from about 0.3 to about 1.25 and preferably from about 0.40 to about 0.90, and more preferably from about 0.5 to about 0.75 based on a methane-to-CO volumetric ratio of 1 to 1. These ratios will change depending upon the requirement for the heat generated and the composition of the exit gas, specifically the required partial pressure of $H_2$.

The oxygen, fuel gas and steam are reacted in the first-stage POX reactor at a pressure of from about 100 psig to about 1,200 psig, and preferably from about 400 psig to about 800 psig, and more preferably from about 500 psig to about 700 psig; and at a temperature within the range from about 1,300° F. to 3,000° F., and preferably from about 1,500° F. to 2,500° F., and more preferably from about 1,800° F. to about 2,300° F.

The first-stage reaction produces a hot gas stream principally comprising hydrogen, CO and steam along with carbon dioxide and minor amounts of other gases such as nitrogen or the like. The temperature within the stage-one reaction is controlled such that the hot gas stream produced is essentially free (for example, totaling less than 0.1 volume percent of the total gas stream) of hydrocarbons, oxygen moieties and hydroxymoities, although there can be a small amount of methane, depending on the conditions. The hot gas stream is preferably mixed with recycle hydrogen from the gas separation unit 22 (described hereinbelow) which has been heated to about 1,000° F. The resulting gaseous mixture having a uniform temperature is then injected into the HDP reactor.

Hydrodisproportionation and Quench

Coal from the preconditioning unit 12 is fed to the hydrodisproportionation (SRT-HDP) reactor and quench unit 16 by gravity and differential pressure. The coal is preferably injected into the reactor through a central feed nozzle where the coal is rapidly heated to effect depolymerization and disproportionation at a thermal equilibrium mix temperature of from about 1,000° F. to about 2,000° F., and preferably at about 1,500° F. to 1,750° F. for bituminous coals and 1,300° F. to 1,500° F. for sub-bituminous and lignites. The coal is heated by contact with hot, hydrogen-containing gas.

As discussed hereinabove, in the POX process sub-stoichiometric oxygen and steam are contacted with reaction gas ($CH_4$/CO rich), preferably from gas separation unit 22, to obtain products including primarily CO, $H_2$ and heat. This hot gas is contacted in the SRT-HDP reactor with coal from unit 12 to rapidly heat the coal to volatilization temperatures. Recycled hydrogen from the gas separation unit that has been preheated to about 1,000° F. can be simultaneously fed to the reactor. Preferably, the coal is heated by intermixing with the gas to from about 1,000° F. to about 2,000° F. at from about 100 psig to about 1,200 psig and is hydrodisproportionated with the volatilized material undergoing hydrogenation.

The hot POX gas rapidly heats the coal at a rate of at least about 10,000° F./second and at ranges from about 10,000° F./second to about 250,000° F./second.

Prior to contacting the coal, the hot gas is accelerated to a velocity to effect intimate contact of the particulate coal with the hot gas stream and to volatilize the coal within a residence time in the reactor of from about 2 milliseconds to about 100 milliseconds, and preferably from about 10 milliseconds to about 75 milliseconds, and more preferably from about 15 milliseconds to about 50 milliseconds, depending on the rank of the coal. Prior to contacting the coal, the hot gas is accelerated to a velocity of from about 200 feet per second to about 1,000 feet per second, and preferably from about 300 feet per second to 800 feet per second, and most preferably from about 400 feet per second to 600 feet per second to effect mixing of solid and gas.

The amount of particulate coal and the amount of hot gas introduced into the HDP reactor can be controlled to produce the desired reaction temperature and residence time. The higher the partial pressure of hydrogen, CO, and steam in the HDP reactor, the more saturated hydrocarbons and $CO_2$ are produced. The reactants and products from the HDP process are rapidly cooled to effect the desired total hydrodisproportionation reaction exposure time.

The prior art injected oxygen into the second stage reaction for heat. Any oxygen present in the second stage reaction of the instant invention is from oxygen in the coal molecule. The important aspect is that there is no "free" oxygen in the feed to the HDP reactor so that water formation is not the preferential reaction.

The first- and second-stage processes may be accomplished in two separate reactors or within a single vessel. In this latter configuration, the carbonaceous feed is introduced into the hot gas from the first stage to effect the second stage. The direction of flow of the products through the reactors or vessel is dependent only upon the longitudinal axial alignment of the reactors or single reactor vessel. The direction of product movement through the first and second stages is not limited to either upflow or downflow when a high velocity propelling force is used to overcome gravitational forces and to insure proper heating profiles and rapid product movement through the reactors. Thus, by using high velocity flows to propel the reaction products through the reactors, the direction of axial alignment of the reactors or vessel can be varied.

Preferably, the first stage of the process is accomplished in a separate unit. In this method, the outlet end of a POX reactor section is connected in close proximity to the inlet end of a reaction section designed to accomplish the second-stage reaction. The two reactor sections can comprise two physically separate, compatible reactors utilizing a high product flow rate, short-residence time, entrained-flow reactor; or the two reaction stages may be integral parts or zones of a single unit. The direction of axial alignment of the reactor is not important since high velocity entrained flow is not gravity dependent so long as the high rate of flow and short exposure time required to achieve the desired product slate is provided.

This two-stage process can be used for the hydrodisproportionation of any solid or semi-solid or even liquid carbonaceous material. Preferably, oxygen is introduced to the POX unit 14 in substoichiometric amounts to maintain the desired operating temperature range in the second-stage volatilization. Steam is added to effect material balance, to enhance the phase shift reaction, and to inhibit the production of water. The amounts are empirical to the feedstock and desired product slate. Steam requirements are therefore dependent upon the second-stage carbonaceous material feed rate, the type of carbonaceous feed introduced, and the operating conditions in the second stage, etc.

Higher temperatures and longer high temperature exposure times in the second stage create a need for greater amounts of hydrogen in the second stage as heavy hydrocarbons are cracked to lighter material. In order to meet second-stage hydrogen requirements, for example, 0.05 to 0.25 pounds of $H_2$ per 1 pound of carbonaceous material is required to be fed into the second stage.

The instant process, which involves the rearranging of hydrogen and the use of hydrogen from constituents in the carbonaceous material, has certain limits. Specifically, the amount of hydrogen that can be produced in this manner is finite. It has been found, however, that with most coals other than anthracite, devolatilization of the coal, cracking of heavier material, and even hydrogenation of some portion of the solid carbon is possible. Of course, the more hydrogen in the feedstock, the more valuable is the fuel produced.

A refractory-lined reactor vessel can be used to volatilize the carbonaceous material. This vessel can be a single vessel for the combined stage-one and stage-two processes, or for the stage-two process only. The refractory lined second-stage vessel can be cylindrical or rectangular in shape.

As part of the second-stage reactor configuration, an injector system is preferably used for rapidly injecting the particulate coal and catalyst and rapidly admixing and heating the coal and catalyst with a hot, hydrogen-rich stream of reducing gases. The coal injector can be centrally located or can comprise a series of manifolded injectors dispersed on the head portion of the reactor. The carbonaceous material and hot gas are preferably injected through rectangular shaped slots with the hot gas stream injection angle not greater than 60 degrees when measured from a horizontal plane. The means for particle injection can be any means known in the art such as gravitational flow, differential pressure, entrained flow, or the like.

Figure 2:
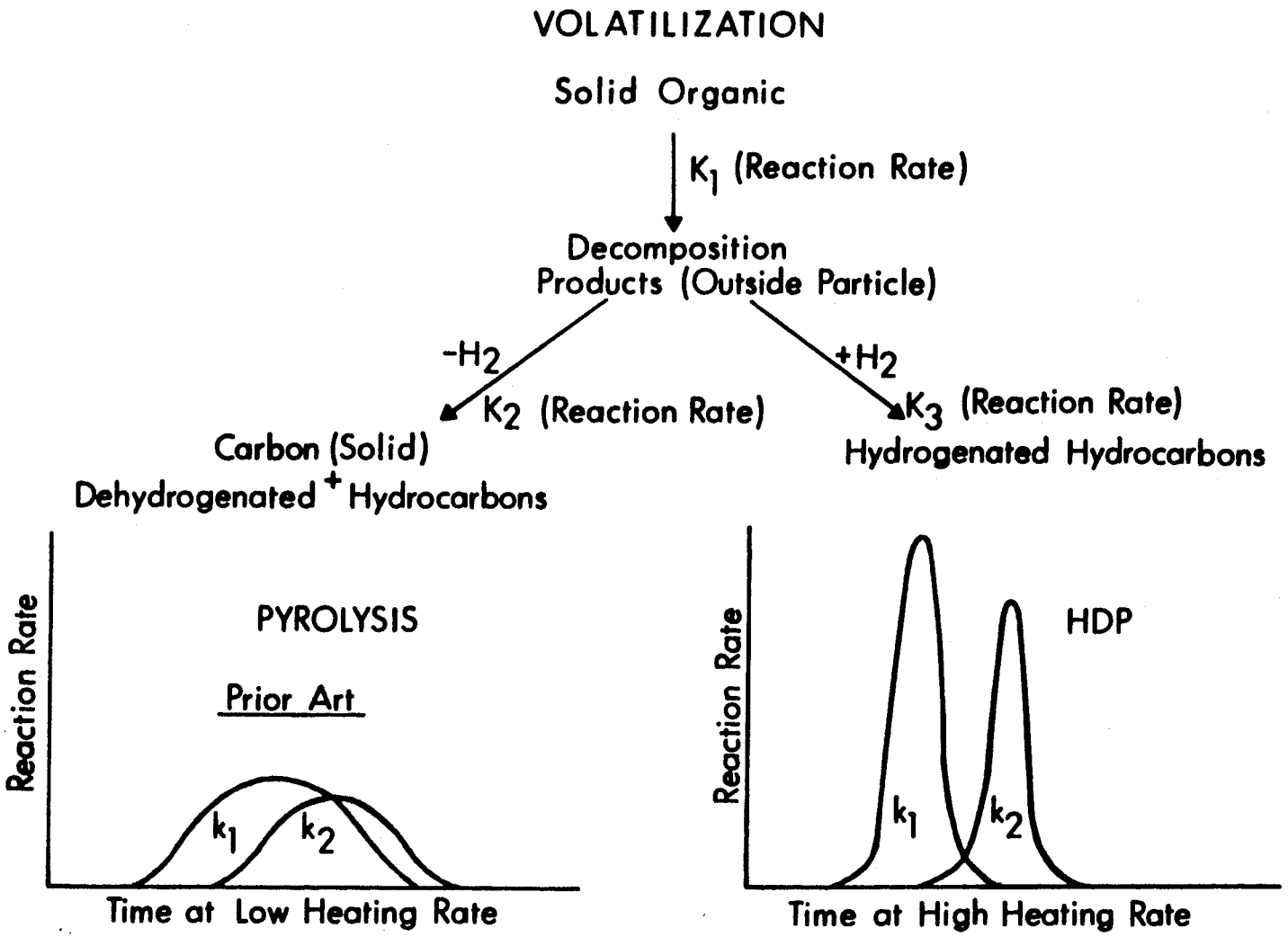
FIG. 2 is a depiction of the reaction rates and reactions associated with the prior art pyrolysis as well as those associated with the HDP reactions of the present invention.

FIG. 2 shows the distinction between the hydrodisproportionation reaction of the instant invention and the prior art pyrolysis process. The following is advanced as explanatory theory only and should not be construed as a limitation of the instant invention. The rapid volatilization and decomposition of volatile containing carbonaceous material is accomplished by heating the carbonaceous material very rapidly to effect a high heating rate (second order function) to a volatilization temperature. This heating rate has been found to increase $k_1$ and minimize the "condensation" reaction rate $k_2$ (see FIG. 2). When decomposition is accomplished at higher heating rates, i.e., in excess of 10,000° F., the decomposed volatilized material is "blown out" of the particle as low molecular weight hydrocarbons which contain free radical sites. If hydrogen is present in the atmosphere surrounding this decomposed material as it exits the particle, the decomposed material is hydrogenated. If the condensation reaction is allowed to proceed at lower heating rates, then the presence of hydrogen in the atmosphere is not as effective.

However, in order to effect high heating rates, the mixing temperature must be relatively high to impart sufficient energy to the coal particle to heat it rapidly in milliseconds of time. These high temperatures, however, dilitariously affect the formation of hydrogenated liquids and promote cracking to gaseous products which use up hydrogen and degrade liquid production.

By immediately adjusting the temperature of the decomposed volatilized material to a hydrogenation temperature (as opposed to stopping the reaction by "stabilization quenching") in the presence of hydrogen, $k_3$ is increased such that hydrogenated, light liquids are produced. As is seen in the reaction schemat in FIG. 2, the concentration of decomposition material available to undergo the "condensation" reaction with reaction constant $k_2$ is minimized. Adjustment of temperature to a hydrogenation temperature also minimizes high temperature thermocracking to gases heretofore believed a necessary product of high heating rate volatilization processes.

The hydrogenated products may be further quenched to cease all reactions after the decomposition products have been sufficiently hydrogenated. Thus, in accordance with the instant invention, the initial heating rate of the coal does not have to determine the ultimate slate of volatilization products, including large amounts of gas, and the condensation reaction can be effectively avoided.

Anterior of the reactor vessel, disposed in an annular fashion about the circumference of the vessel, are one or more sets of quench nozzles through which a quench medium is dispensed to slow down and/or terminate the reaction and to reduce the temperature of the reaction products.

Intermediate Quench

An intermediate quench is used to reduce reactant temperature, inhibit excessive hydrocracking, and promote hydrogenation. Temperatures in the range of from about 900° F. to about 1,500° F., and preferably in the range of from about 1,100° F. to about 1,300° F. are sufficient at residence times in the order of from about 0.1 seconds to about 5.0 seconds. The intermediate temperature reduction is accomplished in a single quench step. Mechanical-type injection nozzles that produce a uniform quench medium injection flow pattern are preferred. Injection nozzles are preferably oriented at an angle of from about 60° to about 90° when measured from a vertical plane. When heavy oil is used as a quench medium, atomizer type injection nozzles are preferred. Steam or heated gas can be used as the atomizing agent to produce a fine oil mist when injected into the quench zone of the HDP reactor. Oil mist particles less than 100 micron size are required for rapid heat-up and vaporization.

Recycled hydrogen-rich gas is a preferred quench medium. In addition to reducing reactant temperatures, the recycled hydrogen-rich gas increases the hydrogen partial pressure and thereby increases the rate of hydrogenation of the volatilized material. Recycled hydrogen-rich gas temperatures in the range of from about 70° F. to about 200° F. are required, depending on the desired temperature reduction and hydrogen partial pressure.

Recycled heavy hydrocarbon process liquid which undergoes hydrocracking during the intermediate quench step is a greatly preferred quench medium. Heavy hydrocarbon process liquid temperature in the range of from about 150° F. to about 550° F. is required. The viscosity of the heavy hydrocarbon process liquid in this temperature range is sufficiently low that atomizing type spray nozzles can be used.

Final Quench

The hydrogenated HDP vapor is subjected to a final quench to terminate reactions. The final quench step preferably uses recycle water and lighter oils (primarily hydrocarbons boiling at less than 400° F.) to reduce the temperature of the HDP volatiles to a stabilization temperature below about 900° F., preferably from about 700° F. to about 900° F., to prevent reaction (polymerization) of unsaturated hydrocarbons and free radicals and to inhibit further "thermal cracking" to gas.

In this quench process, there are no indirect heat exchangers and the heat for the fractional distillation is transferred to the liquids to be distilled directly by interaction in the reactor in this quench step. Thus, no reheating is required and a "step down" process is provided. This also allows further generation of lighter oils for slurrying the char and precludes the need to use the tars for an enhanced solid product.

The quantity of quench liquid is determined by its latent heat of vaporization and heat capacity or ability to absorb the sensible heat of the HDP vapors. The quench medium can comprise any liquids or gases that can be blended rapidly and in sufficient quantity with the reactant mixture to readily cool the mixture below the effective reaction temperature. The cooling down or quenching of the reactant HDP vapors can occur within the HDP reactor or subsequent to the departure of the gases from the HDP reactor. For example, the reactant vapors can be quenched in the pipe line between the HDP reactor and char separator by quench nozzles located in the pipe line.

Reactor Products

The short exposure time in the HDP is conducive to the formation of aromatic liquids and light oils. It has been found that rapid heating depolymerization of carbonaceous materials not only "drives out" the volatiles from the feed particles (devolatilization), but also thermally cracks larger hydrocarbons into smaller volatiles which escape from the host particle so rapidly that condensate reactions are largely bypassed. With a rapid quench to hydrogenation temperatures, these volatiles are stabilized first by reaction with hydrogen to form a less reactive product and then by lowering the internal energy of the volatiles below the reactive energy level. The net result is the rapid production of these volatiles to prevent polymerization to heavy oil or tar (high molecular weight compounds) and the maximization of lighter hydrocarbon liquids.

The HDP reactor product slate includes primarily $H_2$, CO, $CO_2$, $H_2S$, $NH_3$, $H_2O$, $C_1$ to $C_4$ hydrocarbons, benzene, toluene, and xylene, minus 700° F. boiling liquids and plus 700° F. boiling liquids. The product slate is dependent upon the coal type and operating parameters, such as pressure, temperature, and second-stage residence time, which can be varied within the reactor system. It has been found that the presence of CO, $CO_2$, and $CH_4$ in the feed to the second-stage HDP reactor does not inhibit the production of benzene, toluene, xylene (BTX) and other liquid products in a short-exposure time, high-temperature hydropyrolysis. Methane and carbon dioxide are merely diluents which have little effect on the second-stage reactions. The concurrent presence of water vapor is required to inhibit the formation of water ($H_2+\frac{1}{2}O_2 \rightarrow H_2O$) and the net reaction extracts hydrogen from water to provide some of the hydrogen consumed in the hydrogenation reactions. Hydrogen is extracted from water vapor in the first-stage to satisfy the hydrogen needs in the second-stage.

The total carbon conversion, expressed as the percentage of the carbon in the gases and liquids found in the second-stage end products to the total amount of carbon in the second-stage carbonaceous feed material, ranges from about 30 weight percent to about 70 weight percent. The component carbon conversion expressed as the percentage of carbon converted to that component in the second-stage end product to the amount of carbon in the second-stage carbonaceous feed material ranges as follows: $C_1$–$C_4$ hydrocarbons from about 5 weight percent about 25 weight percent; BTX from about 1 weight percent to about 20 weight percent; minus 700° F. boiling liquids (excluding BTX) from about 1 weight percent to about 35 weight percent; and plus 700° F. boiling liquids from about 0 weight percent to about 20 weight percent.

The second-stage product gases are useful for the extraction of marketable by-products such as ammonia, a hydrogen source for hydrotreating the product oil, a fuel for use in combustion systems, and a feedstock for the production of lower chain alcohols which can be used as a hydrocarbon-rich liquid to alter the viscosity f the slurry liquids and the flow characteristics of the slurry. In accordance with a preferred embodiment, these gases are used primarily to produce lower chain alcohols which are admixed with the liquid organic fraction. Advantageously, the gases are "sweetened" prior to being marketed or used in the process. The elimination of potential pollutants in this manner not only enhances the value of the slurry as a non-polluting fuel but also improves the economics of the process since the gaseous products may be captured and marketed or utilized in the process.

Char Separation

The quenched HDP vapor and char is sent to a primary char separator, unit 18 in FIG. 1, where most of the char is separated from the vapor. The vapor stream is then sent to a secondary separator to remove additional char. The vapor, now containing only a small amount of char dust, is conveyed to cooling and separation unit 24.

The separated char can then be fed to a lockhopper system for depressurization to atmospheric pressure. Char discharged from the lockhoppers is normally fed to surge bins. The char from these storage bins can then be pneumatically conveyed with nitrogen to char cooling and grinding unit 20.

Char Cooling and Grinding

Particulate char is preferably fed to facilities, unit 20 in FIG. 1, for cooling and sizing prior to mixing it with hydrotreated oil from hydrotreating and fractionation unit 34 to produce a fluidic fuel system. This char is normally cooled from about 900° F. to about 100° F. and can be pulverized to about 95% less than 375 mesh.

Part of the hot char from the char separation unit 18 can be diverted to a boiler, for example, a fluidized bed boiler (not shown), to generate the steam required in preconditioning unit 12. The remainder of the hot char is cooled to about 520° F. by generating 600 psig steam in a series of heat exchangers also for use in the partial oxidation unit 14. The char is further cooled to 100° F. to 145° F. by cooling water in a second set of heat exchangers. The cooled char is sent to a separator where the char is separated from the carrier gas (nitrogen) before going to storage bins. (Nitrogen, a surplus byproduct of oxygen manufacture, is an inert carrier gas). The cooled char is fed to nitrogen swept pulverizers. The pulverized char is pneumatically transported to a cyclone separator where it is separated from the nitrogen carrier gas. The separated nitrogen is sent to a bag filter to remove char dust prior to being vented to the atmosphere.

Fluidic Fuel System Preparation

The pulverized char, hydrotreated oil, methanol and water are preferably mixed to produce a substantially combustible fluidic fuel. Preferably, this fuel is a three-phase system comprising solid char, hydrocarbons and an amount of water effective to form an emulsion. Cooled, pulverized char from char cooling and grinding unit 20 is fed to a char storage bin. The char is fed through a feeder to a mix tank where the char is mixed with hydrotreated oil from hydrotreating and fractionation unit 34, hydrocarbon-rich condensed water from the condensor in unit 28, and a methanol/water mixture from methanol synthesis unit 30. The fluidic fuel product from the mix tank is then pumped to storage (not shown).

Cooling and Separation (Fractional Condensation)

The char dust is scrubbed from the HDP vapor and the HDP vapor is cooled and condensed. The facilities to accomplish this processing are represented in unit 24 of FIG. 1. Cooling and separation unit 24 accepts HDP vapor having a temperature of from about 700° F. to about 1,000° F. and preferably at about 850° F. in four consecutive cooling steps. Liquid hydrocarbons and water are also condensed and collected for separation in an oil-water separator. Facilities are also available to scrub ammonia to less than 10 ppm in the gas before being sent to gas purification unit 32.

In a first cooling step, HDP vapor at about 850° F. from char separation unit 18 is cooled to about 520° F. in a heat exchanger where saturated steam is generated. The partially cooled HDP vapor stream is sent to a scrubber and then to a vapor-liquid separator where condensed heavy hydrocarbons are separated from the cooled vapor stream. Part of the condensed liquid from the bottom of the separator is recirculated to the scrubber where it contacts the HDP vapor stream to remove residual entrained char dust from the HDP vapor. The remainder of the condensed heavy oil is recycled to the HDP reactor and quench unit 16 as the primary quench fluid.

In a second cooling step, the HDP vapor at about 520° F. is , circulated through a second heat exchanger where it is cooled to about 300° F. by generating lower temperature saturated steam. This cooled stream is moved to a second separator where condensed oil and water are separated from the vapor in an oil-water separator in unit 24.

Vapor from this second separator is circulated through a third heat exchanger in a third cooling step where it is further cooled to about 290° F. by preheating boiler feed water. The liquid-vapor stream then goes to a third separator for separation of the liquid from the vapor. The separated liquid stream (oil and water) is sent to an oil-water separator.

In a fourth cooling step, vapor from the third separator is sent to an air cooler where it is cooled to about 145° F. with air and then cooled to about 100° F. by a water cooled exchanger.

The cooled vapor-liquid stream goes to a fourth separator (bottom section of the ammonia scrubber) where the light condensed oil and water are separated. The vapor then goes to a packed bed section in the ammonia scrubber where it is contacted with water to remove any remaining ammonia and acid gas. Part of the condensed oil and water from the bottom of the ammonia scrubber is used as the final quench liquid for the hot HDP vapor produced in the SRT-HDP reactor. The remainder of the condensed light oil and water is sent to an oil-water separator within the cooling and separation unit 24.

The oil-water separator in unit 24 is designed to separate the condensed oil from water in the three oil/water streams and to provide intermediate storage of the separated oil and water streams.

The heavy oil-water stream from the second separation is cooled and sent to a heavy-oil expansion drum where the pressure is reduced and where most of the dissolved gases in the heavy-oil water mixture are released. The de-gassed heavy oil-water mixture is sent to a heavy oil separator where heavy oil is separated from lighter oil and water. The lighter oil and water are then sent to another oil-water separator where the light oil is separated from the water. The separated heavy oil and light oils are then sent to oil run-down tanks. Water from the bottom of the separator is sent to a sour water storage tank.

The medium oil-water stream from the third separator is cooled, then mixed with the light oil-water stream from the fourth separator and sent to a medium and light oil expansion drum. The released gas is mixed with the gas from the heavy oil expansion drum and then cooled to about 100° F. in an water cooled heat exchanger. The oil-water mixture from the expansion drum is sent to a separator where the oil is separated from the water. Separated oil is sent to an oil run-down tank from which it is pumped to the hydrotreating and fractionation unit 34. Water from the bottom of this oil separator is also sent to the sour water tank before being sent to unit 28 water treating.

Sour ammonia-containing water is sent to an ammonia still (steam stripper) where acid gas and ammonia are stripped from the water and anhydrous ammonia with a purity of greater than 99.5 wt. percent is recovered. Stripped water from the bottom of the ammonia still is sent to flash drum where a small amount of the water is flashed and recycled to the still. Remaining water from the flash drum is separated into two streams. One stream goes to a water cooled exchanger where the stripped water is cooled for re-use in the plant as previously described. The second stream is sent to a brine concentrator where dissolved organics and salts are concentrated in a brine stream. The concentrate is sent to slurry preparation unit 36. A useful water treatment/ammonia stripping and recovery section is the proprietary process licensed by United Engineers and Consultants (subsidiary of U.S. Steel).

The stripped ammonia and sulfur-containing acid gas from the ammonia still are sent to an ammonia absorber where the ammonia is selectively separated from the acid gas, utilizing, for example, a lean ammonium phosphate solution as the solvent. The acid gas from the absorber overhead is sent to the sulfur recovery unit 26. The anhydrous ammonia, after separation from the water, is condensed and pumped to storage (not shown).

Hydrotreating and Fractionation

Unit 34 represents a facility to hydrotreat, hydrodesulfurize and hydrodenitrify naphtha and oil produced in the hydrodisproportionation of coal. This process renders these co-products substantially non-polluting, i.e., containing little, if any, $SO_x$ or fuel $NO_x$. This unit area is divided into two sections: a naphtha hydrotreating/BTX recovery section and an oil hydrotreating/fractionation section.

The naphtha hydrotreating section desulfurizes and denitrifies the naphtha to less than 1 ppm and 0.1 ppm respectively. A commercial grade BTX product is recovered along with a naphtha product, both of which are useful as gasoline blending stock and/or chemical feedstock.

The oil hydrotreating section hydrotreats and stabilizes the oil such that it will not polymerize, and desulfurizes the oil to less than 0.15 percent sulfur. The oil hydrotreater also reduces nitrogen to less than 2000 ppm and oxygen to less than 100 ppm. This process renders the fluidic fuel produced from this oil substantially free of fuel $NO_x$ and $SO_x$ pollutants in accordance with one aspect of the instant invention.

In a preferred embodiment, a process is employed for further treating the liquid organic fraction to adjust viscosity. Numerous processes for hydrotreating liquid hydrocarbons are known and readily available in the art. The paramount consideration in the present invention is to obtain a maximum amount of liquids having a viscosity consistent with producing a fluidic fuel that is capable of pipeline transport and of loading a maximum of a particulate solid coal char while being combustible in a liquid-fueled combustion system.

The separated liquid hydrocarbons ("oil") require further treatment to increase the hydrogen-to-carbon ratio and to reduce the sulfur and nitrogen content. This is accomplished by contacting the oil with hydrogen in a catalytic reactor ("hydrotreater") at moderate pressure and temperature. The hydrogen reacts with the sulfur and nitrogen contained in the oil to produce hydrogen sulfide and ammonia and further hydrogenates the oil. Light oil is separated from heavier oil and then further processed to separate benzene, toluene, and xylene (BTX), and naphtha.

Gas Purification

All of the gas handling facilities required for gas purification are represented by unit 32 in FIG. 1. Sour gas from the cooling and separation unit 24 is sent to gas purification where sulfur components are removed to less than 0.2 ppm and carbon dioxide is reduced to about 3.0 percent so the resultant gas may be used in the methanol synthesis unit 30. Naphtha range hydrocarbons, and trace quantities of ammonia and hydrogen cyanide are also removed from the gas. An example of such a commercially available gas purification unit is the "Rectisol" process licensed by Lurgi, Frankfurt, West Germany.

A compressor for carbon dioxide is included in unit 32. $CO_2$ off-gas separated from the sour gas in gas purification unit 32 is sent, for example, to a two case, electric motor driven, centrifugal compressor where the $CO_2$ is compressed in 4 stages with air coolers followed by water cooled exchangers. An air after-cooler followed by a water cooler is also provided to cool the compressed (fluid) $CO_2$ to about 100° F. prior to being sent to a pipeline.

Sour gas from cooling and separation unit 24 is cooled by cool purified gas and refrigerant to condense residual water vapor in the gas. The condensed water is separated from the gas and sent to water treating unit 28.

The cooled gas is then sent to an $H_2S$ absorber. The gas is contacted with a solvent in the bottom of the $H_2S$ absorber to remove naphtha boiling range hydrocarbons plus residual water, ammonia, and hydrogen cyanides. The gas then flows to the main $H_2S$ absorber section where $H_2S$ and COS are removed by cold $CO_2$-ladened solvent.

The desulfurized gas then goes to a $CO_2$ absorber where most of the $CO_2$ is removed from the gas by cold regenerated solvent. The cold, purified gas is heated by cross-exchange with the incoming sour gas prior to being sent to methanol synthesis and purification unit 30.

The solvent containing $H_2S$, COS and $CO_2$ from the $H_2S$ absorber is flashed to release dissolved gases ($H_2$, CO, $CH_4$, etc.). The solvent is further depressurized in a series of flashes to remove part of the dissolved $CO_2$. The enriched $H_2S$ solvent stream is sent to hot regeneration.

$CO_2$-rich solvent from the $CO_2$ absorber is flashed to release dissolved gases and is then further flashed to remove part of the dissolved $CO_2$. The partially regenerated solvent is recycled to the mid-section of the $CO_2$ absorber.

The released $CO_2$ from the $CO_2$ flash tower and from the $H_2S$ reabsorber are combined, heated and sent to the $CO_2$ compressor and then to a $CO_2$ pipeline. $H_2S$-rich solvent from the $H_2S$ reabsorber is heated by cross exchange with hot regenerated solvent from the regenerator and then stripped in the hot regenerator to separate dissolved $H_2S$, COS, $CO_2$ and light hydrocarbons. The stripped gas is sent to sulfur recovery unit 26.

The solvent stream from the bottom of the $H_2S$ absorber containing naphtha and dissolved gases is flashed in a pre-wash flash tower. The flashed gases are recycled to the $H_2S$ reabsorber. The solvent-naphtha stream from the flash tower is sent to a naphtha extractor where the naphtha is separated from the solvent. The recovered raw naphtha is sent to hydrotreating and fractionation unit 34. The water-solvent stream from the extractor is sent to an azeotrope column. Residual naphtha, dissolved gases and some water and solvent are stripped in the overhead of the azeotrope column and recycled to the pre-wash flash tower Water-solvent mixture from the bottom of the azeotrope column is pumped to the solvent-water column where the solvent is stripped from the water and sent to the regenerator. Waste water from the bottom of the solvent-water column is collected and sent to water treating unit 28.

Sulfur Recovery

Sulfur from the various sour gas streams produced in the plant is recovered by facilities represented as unit 26. Acid gas from gas purification unit 32 is sent to an $H_2S$ absorber where hydrogen sulfide and some of the carbon dioxide in the gas is absorbed using, for example, a SCOT solvent. The desulfurized gas, containing primarily light hydrocarbons, hydrogen and carbon dioxide are sent to the plant fuel gas header. The solvent from the absorber containing hydrogen sulfide and carbon dioxide is sent to a solvent stripper where the $H_2S$ and $CO_2$ are stripped from the solvent. The stripped acid gas is then sent to a reaction furnace. The $H_2S$ is converted to elemental sulfur by methods well known in the art. An example of such a device is a Claus unit. The sulfur produced is sent to a sulfur storage unit (not shown).

Once-Through Methanol Synthesis and Purification

In accordance with one aspect of the instant invention, crude methanol is produced in a once-through reactor and part of the crude methanol is purified to meet Federal Grade AA specifications. This area, represented by unit 30 of FIG. 1, also produces a methanol-rich water stream for mixing with the fluidic fuel to enhance rheological properties and reduce thermal $NO_x$ emissions. The remainder of the methanol is used as an oxygenated motor fuel.

Purified gas from gas purification unit 32 is compressed to methanol synthesis pressure in, for example, a turbine driven synthesis gas compressor. Part of the compressed gas is cooled in, for example, a water cooled exchanger and sent to gas separation unit 22. The remainder of the gas is heated by cross exchange with the methanol reactor effluent gas and fed to the methanol reactor. In the reactor, part of the hydrogen reacts with carbon monoxide to produce methanol and a minor amount of hydrogen reacts with carbon dioxide to produce methanol and water. Only about 20% of the hydrogen fed to the methanol reactor is actually converted to methanol. The hydrogen is internally produced as set forth hereinbefore. Small amounts of organics and other alcohols are also produced in the reactor. The preferred reactor is an isothermal catalytic reactor in which the gas flows through tubes containing a catalyst. The exothermic heat of reaction is removed by transferring heat to boiler feed water on the outside of the tubes and generating medium pressure steam.

The effluent gas and methanol from the reactor is partially cooled by preheating the feed gas to the reactor. The stream is further cooled by an air cooler and then a water cooler to condense the contained methanol and water. The non-condensible gas, primarily hydrogen, carbon monoxide and methane with lesser amounts of carbon dioxide, ethane and nitrogen, is purged from the system and sent to unit 22 gas separation. In this process, there is no requirement to compress and recycle the purified gas to the methanol synthesis reactor. This eliminates the expensive compression and recycle steps required in typical methanol processes and allows methanol to be produced as an economical co-product of the present process.

The condensed crude methanol, containing water, dissolved gases, and trace amounts of produced organics, is sent to a pressure let-down drum where part of the dissolved gases and light organics are released. The crude methanol is then sent to a stripper column where the remaining dissolved gases and light organics are stripped. The stripped crude methanol is then sent to a distillation column where pure methanol is recovered in the overhead, condensed and sent to storage. In a conventional process, essentially all of the methanol must be separated, making the process energy intensive and expensive. In the instant process, only part of the methanol is separated, with the remaining methanol-rich water portion from the bottom of the distillation column being sent to fluidic fuel preparation unit 36.

Gas Separation

Hydrogen is separated from purified HDP gases, which are primarily $CH_4$/CO (purge gas) in gas separation facilities represented by unit 22 of FIG. 1. The hydrogen is recompressed and recycled to the hydrodisproportionation and quench unit 16. In addition, part of the separated hydrogen is sent to hydrotreating and fractionation unit 34 for use in naphtha production and oil hydrotreating. Most of the separated gas, primarily methane and carbon monoxide, is heated and sent to the preconditioning unit 12.

Purge gas from once-through methanol synthesis unit 30 is sent to a scrubber where any residual entrained solvent is removed by methods well known in the art. The solvent should be removed from the gas to prevent fouling of the membrane separator in gas separation unit 22. Gas from the scrubber is heated prior to going to the membrane separators. In the membrane separator, $H_2$ is separated from the other gases by semipermeable membranes formed, for example, into hollow fibers. The separated hydrogen (containing small amounts of $CO_2$, CO, and $CH_4$) is compressed in a hydrogen compressor. Part of the compressed, hydrogen rich gas is recycled to hydrodisproportionation and quench unit 16. The remainder of the hydrogen rich gas is sent to hydrotreating and fractionation unit 34. The separated gas consisting primarily of methane and carbon monoxide is heated and sent to the preconditioning unit 12.

Fluidic Fuel

The terms "fluidic fuel" or "liquid/solid mixture" as used herein are meant to include a composition having an amount of the particulate coal char which is in excess of that amount which is inherently present in the liquid organic portion as a result of the hydropyrolysis process.

For most applications, the particulate coal char constituent should comprise not less than about 45% by weight of the composition and preferably from about 45% to about 75% by weight. In accordance with one aspect wherein the char is separated from the liquid at the fuel system destination, the term 'fluidic fuel' is intended to include a composition containing amounts of char as low as 1% by weight, which composition may be further transported, for example, by pipeline, to a refinery or to another combustion facility.

If the fluidic fuel is to be fired directly into a liquid fueled combustion device, the loading and the liquid organic constituents and the viscosity of the liquids may be varied to maximize combustion efficiency, and, in some cases, amounts of alcohol and "make up" hydrocarbon distillates can be added. This enhances combustion characteristics in a particular combustion system configuration and reduces thermal $NO_x$ while enhancing rheology characteristics of the slurry.

Liquid petroleum distillates which can be used include fractions from petroleum crudes or any artificially produced or naturally occurring hydrocarbon compound which is compatible with the coal-derived liquid organic hydrocarbon containing portion used as the fluidic medium in accordance with the instant invention. These would include, without limitation, the aliphatic, cyclo-aliphatic and aromatic hydrocarbons, heterocyclics and phenols as well as multi-ring compounds, aliphatic-substituted aromatics and hydroxyl-containing aliphatic-substituted aromatics. The term aliphatics is used herein to include both saturated and unsaturated compounds and their stereo-isomers. It is particularly preferred to add the lower chain alcohols, including the mono-, di- and trihydroxyl compounds. Preferably, the make-up hydrocarbons do not contain mercaptan, sulfate, sulfite, nitrate, nitrite or ammonia groups.

Preferably, the chars are discrete spherical particles which typically have a reaction constant of from about 0.08 to about 1.0; a reactivity of from about 10 to about 12; surface areas of from about 100 microns to about 200 microns; pore diameters of from about 0.02 milimicrons to about 0.07 milimicrons; and pass 100 mesh, and preferably 200 mesh. Similar chars are described in U.S. Pat. No. 4,702,747. The useful chars have a high reactivity and surface area, providing excellent Btu to weight ratios. They are finely divided particles as distinguished from the larger, "structured" particles of the prior art. The char particles are sufficiently porous to facilitate beneficiation and combustion but the pore size is not so large as to require the use of excessive liquid for a given amount of solid.

It is important, in order to obtain the requisite liquid/-solid mixture having the desired rheological characteristics, that the solid component be discrete, particulate char. The spherical shape of the char particles allows adjacent particles to "roll over" one another, thereby improving slurry rheology and enhancing the solid loading characteristics. When utilizing agglomerating or "caking" coals, preferably the process parameters are regulated so as not to produce an agglomerated char product.

Except for coal feedstocks with an exceptionally low ash content, the char produced during the process should be beneficiated prior to being admixed with the process oil. When indicated, beneficiation may be utilized to clean either the coal or the char. The beneficiation can be performed by any device or process known in the art utilized to extract pollutants and other undesirable inorganics such as sulfur and ash. Beneficiation may be accomplished, for example, by washing, jigging, extraction, oil agglomeration (for coal only), and/or electrostatic separation. The latter three methods remove both ash and pyritic (inorganic) sulfur. When the solvent extraction or oil agglomeration methods are used, it is most advantageous to use the liquid derived from the hydropyrolysis process as the beneficiating agent. The exact method employed will depend largely on the coal utilized in forming the char, the conditions of hydropyrolysis, and the char size and porosity.

The char material is ground to yield the substantially spherical, properly sized particulate coal char. Any conventional crushing and grinding means, wet or dry, may be employed. This would include ball grinders, roll grinders, rod mills, pebble mills, and the like. Advantageously, the particles are sized and recycled to produce a desired distribution. The char particles are of sufficient fineness to pass a 100 mesh screen (Tyler Standard) and about 32% of the particles pass a 325 mesh screen. In accordance with the instant invention, char particles in the 100 mesh range or less are preferable. It will be realized that the particulate char of the instant invention having particle sizes in the above range is important to assure not only that the solid is high in reactivity, but also that the fluidic fuel is stable and can be pumped directly into combustion systems.

The exact distribution of particle sizes is somewhat empirical in nature and depends upon the characteristics of the liquid organic fraction. The rheological characteristics of the fluidic fuel are interdependent upon the viscosity of the liquid fraction and the particle size distribution of the char.

The ground, beneficiated char can be sized by any apparatus known in the art for separating particles of a size on the order of 100 mesh or less. Economically, screens or sieves are utilized; however, cyclone separators or the like can also be employed. The spheroid shape of the primary particle provides spacing or voids between adjacent particles which can be filled by a distribution of second or third finer particle sizes to provide bimodal or trimodal packing. This modal packing technique allows addition of other solid fuel material such as coal to the fluidic fuel without affecting the very advantageous rheology characteristics of the particulate coal char/liquid organic fraction fluidic fuel system of the instant invention. Additionally, this packing mode allows the compaction of substantially more fuel in a given volume of fuel mixture while still retaining good fluidity.

Particulate char produced from certain ranks of coal has pore sizes and absorption characteristics such as to require treating of the char prior to admixing of the particulate char with the liquid to reduce absorption by the char of the liquid phase. Prevention of excessive absorption of organic and/or hydrocarbon liquid by the char is necessary to prevent instability of rheology characteristics. When absorption rates by the char are in excess of from about 10% to about 15%, pretreatment is very beneficial. In accordance with this pretreatment, the char is brought into intimate contact with an amount of the coating or "sealing" material effective to reduce the absorption of liquid by the char. The treatment is effected prior to the particulate char being admixed with the liquid. The sealants or coatings that are useful include organic and inorganic materials which will not produce pollutants upon combustion nor cause polymerization of the fluidic fuel. Since surfactants and emulsifiers are used to enhance fuel stability, care must be taken that the coating or sealant is compatible with the stabilized composition. Sealants and coating materials which are particularly advantageous include parafins and waxes, as well as the longer chain aliphatics, aromatics, polycyclic aromatics, aroaliphatics and the like. Mixtures of various hydrocarbons, such as No. 6 fuel oil, are particularly desirable because of their ready availability and ease of application. Advantageously, the higher boiling liquid organic fractions from the hydropyrolysis of the coal are utilized. The sealant or coating can be applied to the char by spraying, electrostatic deposition or the like. In this manner, one can economically enhance the rheological stability of the fluidic fuel while preserving its usefulness as a non-polluting combustion fuel.

Coal and water, or more preferably the hydropyrolysis gases, can be used to produce methanol and other lower chain alcohols, preferably in accordance with the method previously described. These alcohols are utilized as a component of the liquid phase for the combustible fuel admixture to adjust liquid viscosity and enhance rheology characteristics.

As used herein the term alcohol is employed to mean alcohols (mono-, di- and trihydroxyl) which contain from 1 to about 4 carbon atoms. These include, for example, methanol, ethanol, propanol, butanol and the like. The alcohol may range from substantially pure methanol to various mixtures of alcohols as are produced by the catalyzed reaction of gases from HDP or natural gas. Advantageously, the alcohol constituent can be produced on site at the mine in conjunction with the HDP reaction.

The admixing of the solid particles with the liquid phase can be accomplished by any well-known mixing apparatus in which an organic liquid constituent and a particulate coal char can be mixed together in specific proportion and pumped to a storage tank. Advantageously, emulsifying techniques are used, such as high speed impellers and the like. The method of admixing, and especially emulsifying, will vary the rheology characteristics of the fluidic fuel. Unlike coal/water slurries and coal/oil mixtures, the fuel of the instant invention is transportable by oil pipeline and does not require mixing equipment at the end-use facility. Thus, even small process heat systems can utilize the fuel of the instant invention efficiently and economically.

The important rheological aspect of the fluidic fuel in the instant application is that it is pumpable and stable. This is accomplished by matching the size of the solid char particle, the viscosity of the liquid phase and the stabilizer. Preferably, a small percentage by weight, for example from 1% to about 12%, of water is admixed into the fuel system. This is especially preferable when surfactants which have hydrophyllic moieties are used. The fuel is preferably agitated or blended to produce a suspensoid which is stable under shear stress, such as pumping through a pipeline.

As discussed above, surfactants, suspension agents, organic constituents and the like may be added depending on the particular application. Certain well-known surfactants and stabilizers may be added depending on the viscosity and non-settling characteristics desired. Examples of such substances which are useful in accordance with the instant invention include dry-milled corn flour, gelatinized corn flour, modified cornstarch, cornstarch, modified waxy maize, guar gum, modified guar, polyvinyl carboxylic acid salts, xanthan gum, hydroxyethyl cellulose, carboxymethyl cellulose, polyvinyl alcohol and polyacrylamide. As hereinbefore mentioned, advantageously the admixture of the instant invention demonstrates high fluidity. Thus a high Btu per unit volume mixture is obtained with lower viscosities and higher fluidities. Certain of the well-known stabilizers create adverse rheological characteristics.

As previously set forth, the sizing and packing of the solid is particularly important in obtaining a highly loaded, stable, transportable combustion fuel system. It has been found advantageous to have the solid material smaller than about 100 mesh (Tyler) and about 32% passing a mesh size in the range of 325. Preferably, the viscosity of the liquid organic fraction is in the range of from 17° API to about 20° API. This will, of course, depend on the loading and pumping characteristics desired, the stabilizers used, and whether coal and/or alcohol are present in the slurry in accordance with the instant invention. The degree API is very important in the end-use application, i.e., the combustion system design. Those oil fired systems designed for "heavier" crudes will tolerate more viscious oils and higher loaded slurries.

Pollution Control

As previously stated, the fluidic fuel of the instant invention provides precombustion elimination of pollution causing materials, specifically those which produce $SO_x$ and $NO_x$ upon combustion. The coal and/or the char may be beneficiated to remove pyritic sulfur. Organic fuel nitrogen and organic fuel sulfur are removed during the HDP reaction and further in the hydrotreating and fractionation unit 34.

Methanol can be added to the fluidic fuel as previously described in order to reduce the combustion (thermal) $NO_x$ by reducing the combustion temperature of the slurry. This, along with the uniformity of the fuel and the reactivity of char, greatly reduces the amount of thermal $NO_x$ as compared with the combustion of raw coal which burns with hot spots.

A pulverized or powderized limestone can be added directly to the fluidic fuel highly in excess of stoichiometric amounts to act as a reactant in the combustion of the fuel to reduce the $SO_x$ emissions from pyritic sulfur.

EXAMPLE

The following example is used to demonstrate the increased liquid hydrocarbon yield and improved liquid quality of the instant invention. 10,000 TPD of dry, pulverized bituminous coal at 300° F. is contacted with 2,500° F. hydrogen-rich gas and rapidly heated to about 1,650° F. and devolatilized. The volatilized material and char are partially quenched to an intermediate temperature of about 1,250° F. with 150,000 lbs/hr of recycled heavy hydrocarbon process liquid and 50,000 lbs/hr of recycled hydrogen donor-rich gas. The intermediate quench temperature of 1,250° F. is maintained for about 500 milliseconds. At this temperature and residence time, the heavy hydrocarbon process liquid, consisting primarily of hydrocarbons boiling above 650° F., is cracked to lower boiling liquid hydrocarbons and hydrogenated. The hydrogenated vapors and char are then quenched to 900° F. with 280,000 lbs/hr of a recycled oil-plus-water mixture to essentially terminate all reactions. In this manner, about 270,000 lbs/hr of low sulfur, low nitrogen liquid hydrocarbons with a final boiling point of about 750° F. can be produced. This example illustrates the advantage of the invention in producing a high liquid hydrocarbon yield and a high quality liquid product.

While the invention has been explained in relation to its preferred embodiment, it is understood that various modifications thereof will become apparent to those skilled in the art upon reading the specification and the invention is intended to cover such modifications as fall within the scope of the appended claims.

What is claimed:

1. In a thermal process for producing hydrocarbon-containing liquids by volatilization of a volatile-containing carbonaceous material in the presence of hydrogen donor-rich gas to produce hydrocarbon-containing vapor and solid char as reaction products wherein the volatilization reaction is essentially terminated by a final quench of said reaction products, the improvement which comprises:

partially quenching said reaction products prior to said final quench using at least one quench step with at least one quench medium to effect a hydrogenation temperature for a hydrogenation residence time to increase the quantity and quality of hydrocarbon containing liquids produced in said thermal process.

2. The method of claim 1 wherein said carbonaceous material is selected from coals, lignites, low rank and waste coals, and combinations thereof.

3. The method of claim 1 wherein said at least one quench medium is selected from a group of heavy hydrocarbon liquids, hydrogen donor-rich gas, water or mixtures thereof.

4. The method of claim 3 wherein said heavy hydrocarbon liquids are produced in said thermal process and consist essentially of liquid hydrocarbons boiling above about 500° F.

5. The method of claim 3 wherein the volatilization is carried out at a heat rate of at least 10,000° F./second, a temperature of from about 1,000° F. to about 2,000° F., a residence time of from 0.002 seconds to 2.0 seconds, and a pressure of from about 100 psig to about 1,200 psig.

6. The method of claim 5 wherein said partial quenching effects a hydrogenation temperature of the reaction products of from about 900° F. to about 1,500° F.

7. The method of claim 6 wherein the time between said partial quench and said final quench is sufficient to effect a hydrogenation residence time of from about 0.1 second to about 5.0 seconds.

8. The method of claim 3 wherein said hydrogen donor-rich gas is obtained in substantial part from said carbonaceous material.

9. The method of claim 3 wherein said at least one quench medium is a mixture of heavy hydrocarbon process liquids and hydrogen donor-rich gas.

10. The method of claim 9 wherein said partial quenching effects a hydrogenation temperature of from about 900° F. to about 1,500° for a hydrogenation residence time of from about 0.1 seconds to about 5.0 seconds.

11. The method of claim 2 wherein said partial quenching is effected in two sequential quench steps to effect a hydrogenation temperature wherein:

a) said first partial quench step utilizes heavy hydrocarbon process liquid as a quench medium to effect a hydrogenation temperature of from about 1,200° F. to about 1,500° F. for a first hydrogenation residence time of from about 0.050 seconds to about 1 second; and b) said second partial quench step utilizes a hydrogen donor-rich gas as a quench medium to effect a further reduction in the temperature to a hydrogenation temperature of from about 900° F. to about 1,200° F. for a second hydrogenation residence time of from about 0.10 seconds to about 4 seconds.

* * * * *